US010876528B2

(12) United States Patent
Bendixen et al.

(10) Patent No.: US 10,876,528 B2
(45) Date of Patent: Dec. 29, 2020

(54) SELF ADJUSTING PUMP FOR ICE CREAM FREEZER

(71) Applicant: Tetra Laval Holdings & Finance S.A., Pully (CH)

(72) Inventors: Ole Bendixen, Galten (DK); Erik-J-Wolf Petersen, Vejle (DK); Steen Gyldenlöv, Lystrup (DK)

(73) Assignee: Tetra Laval Holdings & Finance S.A., Pully (CH)

( * ) Notice: Subject to any disclaimer, the term of this patent is extended or adjusted under 35 U.S.C. 154(b) by 261 days.

(21) Appl. No.: 15/737,786

(22) PCT Filed: Jul. 1, 2016

(86) PCT No.: PCT/EP2016/065539
§ 371 (c)(1),
(2) Date: Dec. 19, 2017

(87) PCT Pub. No.: WO2017/005634
PCT Pub. Date: Jan. 12, 2017

(65) Prior Publication Data

US 2019/0003478 A1 Jan. 3, 2019

(30) Foreign Application Priority Data

Jul. 6, 2015 (DK) ..... 2015 70444

(51) Int. Cl.
*F03C 2/00* (2006.01)
*F03C 4/00* (2006.01)
(Continued)

(52) U.S. Cl.
CPC ..... *F04C 15/0026* (2013.01); *F04C 2/08* (2013.01); *F04C 13/001* (2013.01); *F04C 14/28* (2013.01);
(Continued)

(58) Field of Classification Search
CPC ..... F04C 2/08; F04C 13/001; F04C 14/28; F04C 15/0026; F04C 2270/185;
(Continued)

(56) References Cited

U.S. PATENT DOCUMENTS 2,278,340 A * 3/1942 Weinreich ..... A23G 9/20 62/69
2,900,920 A 8/1959 Compton
(Continued)

FOREIGN PATENT DOCUMENTS

EP 3453879 A1 * 3/2019 ..... F04C 2/101
GB 1292628 10/1972
JP 2002-242869 8/2002

OTHER PUBLICATIONS

International Search Report from corresponding PCT Application No. PCT/EP2016/065539 dated Oct. 19, 2016 (2 pages).
(Continued)

*Primary Examiner* — Theresa Trieu
(74) *Attorney, Agent, or Firm* — Finnegan, Henderson, Farabow, Garrett & Dunner LLP

(57) ABSTRACT

A self adjusting gear pump (10) for an ice cream freezer and a control unit (20) for adaptively controlling the closing pressure (PCLOSE) of a pump for an ice cream freezer. The gear pump system comprises a pump casing (11), an inlet (12) for receiving a liquid food product of ice cream mix, an outlet (15) for transferring the ice cream mix into a freezing cylinder (41) of the ice cream freezer (40), wherein the pump (10) is closed by supplying a closing air pressure onto a moveable pump cover (16) of the pump via at least one hole (191, 192) provided straight through the pump casing (11), thereby moving said moveable pump cover (16) against the star wheel (14) and a control unit (20) for
(Continued)

supplying a calculated closing air pressure (PCLOSE) to the pump by means of the air pressure regulator (100).

8 Claims, 4 Drawing Sheets

(51) Int. Cl.

| | |
|---|---|
| ***F04C 2/00*** | (2006.01) |
| ***F04C 15/00*** | (2006.01) |
| ***F04C 2/08*** | (2006.01) |
| ***F04C 13/00*** | (2006.01) |
| ***F04C 14/28*** | (2006.01) |

(52) U.S. Cl.
CPC ..... *F04C 2240/20* (2013.01); *F04C 2240/30* (2013.01); *F04C 2270/185* (2013.01); *F04C 2270/215* (2013.01); *F04C 2270/70* (2013.01); *F04C 2270/80* (2013.01); *F04C 2270/86* (2013.01)

(58) Field of Classification Search
CPC ..... F04C 2270/215; F04C 2270/70; F04C 2270/80; F04C 2270/86; F04C 2240/20; F04C 2240/30
USPC ..... 418/1, 2, 131–132, 134, 166, 171, 270
See application file for complete search history.

(56) References Cited

U.S. PATENT DOCUMENTS

| | | | | | |
|---|---|---|---|---|---|
| 2,944,487 | A | * | 7/1960 | Walsh | F04C 15/06 418/15 |
| 3,018,641 | A | * | 1/1962 | Carpigiani | F01C 1/123 418/206.6 |
| 3,628,893 | A | * | 12/1971 | Carpigiani | F04C 15/06 418/15 |
| 3,876,349 | A | * | 4/1975 | Svensson | F04C 2/101 418/169 |
| 4,316,490 | A | * | 2/1982 | Meyer | A23G 9/20 141/100 |
| 4,746,276 | A | | 5/1988 | McBurnett | |
| 5,163,825 | A | * | 11/1992 | Oetting | F01C 1/44 418/153 |
| 5,236,317 | A | | 8/1993 | Lonsberry | |
| 5,363,649 | A | | 11/1994 | McBurnett | |
| 6,089,469 | A | | 7/2000 | Fusama et al. | |
| 2011/0052811 | A1 | | 3/2011 | McGuffey | |
| 2014/0105776 | A1 | | 4/2014 | Ellero et al. | |

OTHER PUBLICATIONS

Office Action from corresponding Danish Application No. PA 2015 70444 dated Feb. 12, 2016 (7 pages).

* cited by examiner

SELF ADJUSTING PUMP FOR ICE CREAM FREEZER

CROSS-REFERENCE TO RELATED PATENT APPLICATIONS

This is a National Phase of International Application No. PCT/EP2016/065539, filed Jul. 1, 2016, which claims the benefit of Danish Application No. PA 2015 70444, filed Jul. 6, 2015. The entire contents of the above-referenced applications are expressly incorporated herein by reference.

TECHNICAL FIELD

The present invention pertains to a self adjusting pump for an ice cream freezer, and in particular to a control unit for adaptively controlling the closing pressure of a pump for an ice cream freezer.

BACKGROUND

Ice cream freezers allow for continuous freezing and whipping of ice cream mix with air to produce ice cream and other frozen desserts. Commonly, an ice cream freezer uses an inlet gear pump to feed ice cream mix into a freezing cylinder. A constant airflow is fed into the cylinder together with the mix. During the passage through the cylinder the air is whipped into the mix by a dasher and inner beater. Refrigerant surrounding the cylinder provides the freezing. Stainless steel blades scrape the frozen ice cream from the inside wall of the cylinder, and a second gear pump pushes the ice cream forward for filling or extrusion.

The operation state of each gear pump is controlled by a mechanically fixed pump cover, which is manually adjustable to some degree. The pump is adjusted by a threaded pin and a fixed nut by which the position of the impeller in relation to the star wheel is controlled, thus adjusting the clearance between the impeller, star wheel and pump cover.

The adjustment process of the pump system in conventional ice cream freezer is cumbersome and may also lead to excessive wear or to high leakage of the pump in case the adjustment is wrongly executed.

Accordingly, an improved pump system for an ice cream freezer would be advantageous.

SUMMARY OF THE INVENTION

It is, therefore, an object of the present invention to overcome or alleviate the above described problems.

An idea of the present invention is to remove the need for manual adjustment of the clearance in a pump for an ice cream freezer by allowing for self adjustment of said clearance.

According to an aspect a control unit for adaptively controlling closing pressure of an inlet gear pump of an ice cream freezer is provided. The inlet gear pump comprises a pump casing, an inlet for receiving a liquid food product of ice cream mix, and an outlet for transferring the ice cream mix into a freezing cylinder of the ice cream freezer. The inlet is connected to an impeller driving a star wheel which in turn is connected to the outlet. The pump is closed by supplying a closing air pressure onto a movable pump cover of the pump via at least one hole provided straight through the pump casing, thereby moving said movable pump cover against the star wheel. The control unit is configured to:

receive a first measure of liquid food product supply pressure ($P_{IN}$, P1) at the inlet of the pump, receive a second measure of liquid food product outlet pressure ($P_{OUT}$, P2) at the outlet of the pump, calculate a closing air pressure ($P_{CLOSE}$) being determined by the differential pressure between the liquid food product outlet pressure ($P_{OUT}$, P2) and the liquid food product supply pressure ($P_{IN}$, P1) across the pump (10), and supply the calculated closing air pressure ($P_{CLOSE}$) to the moveable pump cover by means of an air pressure regulator via the at least one hole in the pump casing, thereby forcing the moveable pump cover against the star wheel thereby closing the pump.

According to a further aspect a control unit for adaptively controlling closing pressure of an outlet gear pump of an ice cream freezer is provided. The outlet gear pump comprises a pump casing, an inlet for receiving a liquid food product of frozen ice cream from a freezing cylinder of the ice cream freezer, and an outlet for transferring the frozen ice cream for filling or extrusion. The inlet is connected to an impeller driving a star wheel which in turn is connected to the outlet. The pump is closed by supplying a closing air pressure onto a moveable pump cover of the pump via at least one hole provided straight through the pump casing, thereby moving said moveable pump cover against the star wheel. The control unit is further configured to:

receive a first measure of liquid food product supply pressure ($P_{IN}$, P2) at the inlet of the pump, receive a second measure of liquid food product outlet pressure ($P_{OUT}$, P3) at the outlet of the pump, calculate a closing air pressure ($P_{CLOSE}$) being determined by the differential pressure between the liquid food product outlet pressure ($P_{OUT}$, P3) and the liquid food product supply pressure ($P_{IN}$, P2) across the pump (10), and supply the calculated closing air pressure ($P_{CLOSE}$) to the moveable pump cover by means of an air pressure regulator via the at least one hole in the pump casing, thereby forcing the moveable pump cover against the star wheel thereby closing the pump.

According to yet another aspect a gear pump system for an ice cream freezer is provided. The system comprises a gear pump comprising a pump casing, an inlet for receiving a liquid food product of ice cream mix, an outlet for transferring the ice cream mix into a freezing cylinder of the ice cream freezer, wherein the inlet is connected to an impeller driving a star wheel which in turn is connected to the outlet; wherein the pump is closed by supplying a closing aft pressure onto a moveable pump cover of the pump via at least one hole provided straight through the pump casing, thereby moving said moveable pump cover against the star wheel, and a control unit according to one or more other aspects for supplying a calculated closing air pressure ($P_{CLOSE}$) to the pump by means of the air pressure regulator via the at least one hole in the pump casing.

According to yet another aspect a gear pump system for an ice cream freezer is provided. The system comprises a gear pump comprising a pump casing, an inlet for receiving a liquid food product of frozen ice cream from a freezing cylinder of the ice cream freezer, an outlet for transferring the frozen ice cream for filling or extrusion, wherein the inlet being connected to an impeller driving a star wheel which in turn is connected to the outlet, wherein the pump is closed by supplying a closing air pressure onto a moveable pump cover of the pump via at least one hole provided straight through the pump casing, thereby moving said moveable pump cover against the star wheel. The system further comprises a control unit according to one or more other aspects for supplying a calculated closing air pressure to the pump by means of the air pressure regulator via the at least one hole in the pump casing.

According to another aspect an ice cream freezer comprising the gear pump system and the gear pump system is provided.

According to an aspect a method for adaptively closing a gear pump for an ice cream freezer is provided. The method comprises:

receiving a first measure of liquid food product supply pressure ($P_{IN}$, P1, P2) at an inlet of the pump;

receiving a second measure of liquid food product outlet pressure ($P_{OUT}$, P2, P3) at an outlet of the pump;

calculating a closing air pressure being determined by the differential pressure between the liquid food product outlet pressure ($P_{OUT}$, P2, P3) and the liquid food product supply pressure ($P_{IN}$, P1, P2) across the pump; and supplying the calculated closing air pressure to a moveable pump cover of the pump by means of an air pressure regulator via at least one hole in pump casing (11) of the pump, thereby forcing the moveable pump cover against a star wheel of the pump, thereby closing the pump.

BRIEF DESCRIPTION OF THE DRAWINGS

The above, as well as additional objects, features, and advantages of the present invention, will be better understood through the following illustrative and non-limiting detailed description of preferred embodiments of the present invention, with reference to the appended drawings, wherein.

DETAILED DESCRIPTION

An idea of the present invention is to replace the commonly known mechanically fixed, and manually adjustable pump cover with a movable pump cover which position in the pump is controlled pneumatically. Pneumatic air pressure can be applied on a backside thereof. The air pressure press the pump cover against the star wheel and impeller and thereby closing the pump during operation. The air pressure is controlled by a control unit and adjusted as a function of the differential pressure over the pump.

The pump according to the embodiments is associated with several advantages. For example, it eliminates manual adjustment and thereby the risk for wrong adjustment which can lead to excessive wear or to high leakage of the pump. Furthermore, the wear of the pump is reduced due to adjustment of the closing pressure as a function of the actual differential pressure. Moreover, the functionality of the pump is more accurate function, i.e. allowing for less leakage, due to continuous adjustment during the whole life span of the pump.

Figure 1:
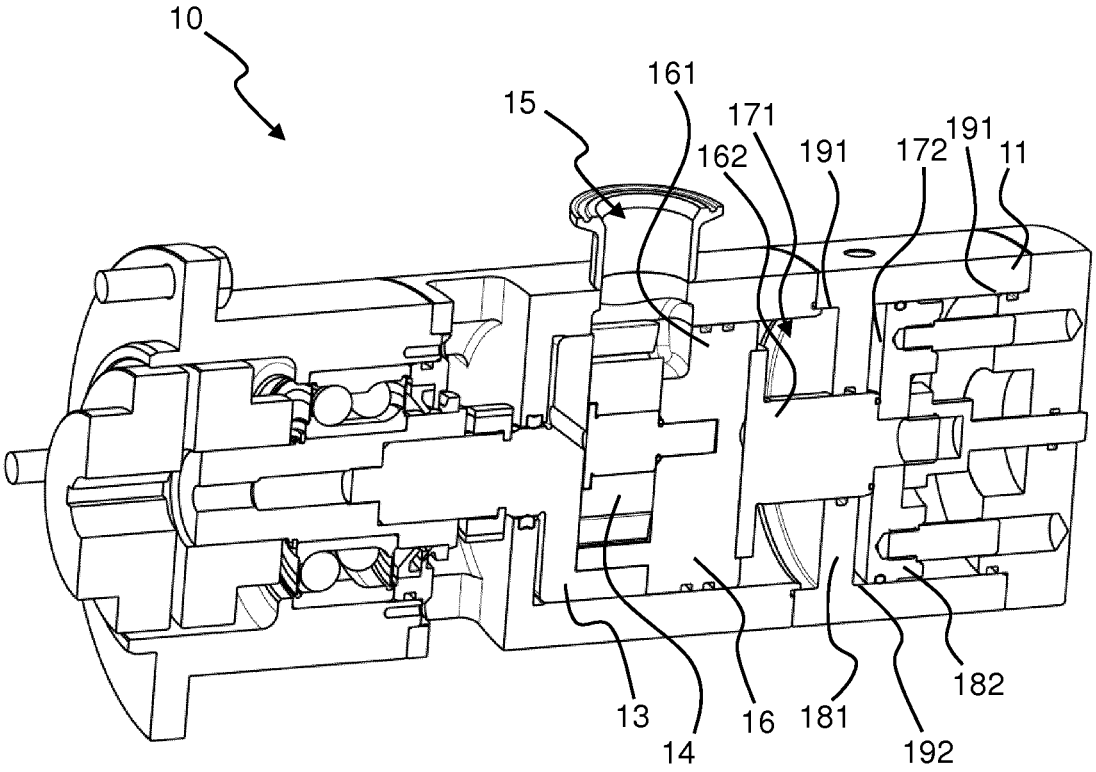
FIG. 1 illustrates a pump according to an embodiment.
Figure 6:
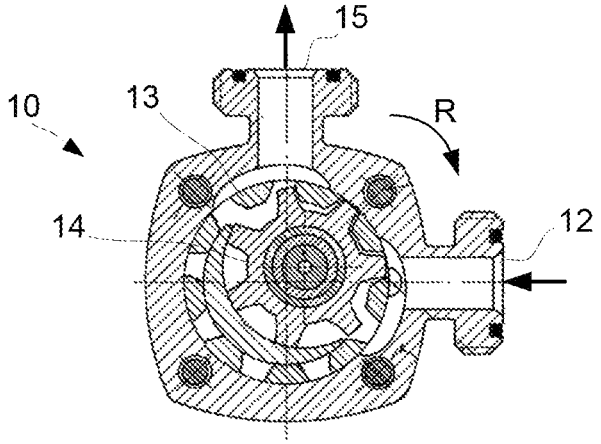
FIG. 6 shows another view of a pump according to an embodiment.

FIG. 1 illustrates a pump 10 according to an embodiment. The pump 10 comprises a pump casing 11, inlet 12 (see FIG. 6) for receiving a liquid or frozen food product. An impeller 13 and star wheel 14 forces the liquid food product towards an outlet 15. The pump has two functions, either it is used to control a steady flow through the pumps or a pressure on the inlet. The pump cover comprises a head portion 161 and a rod portion 162. The movable pump cover 16 is moveable in an axial direction for engagement and disengagement with the impeller 13. The rod portion 162 is sealingly and slidably arranged to a closing partition wall 181 rigidly attached to the pump casing 11. Furthermore, the rod portion 162 is fixedly arranged to an opening partition wall 182 which is sealingly and slidably arranged to an interior wall of the pump casing.

The pump casing further comprises at least one first hole 191 provided straight through the pump casing 11, for receiving a pneumatic closing pressure from an air pressure regulator (not shown). The first hole 191 accesses a cavity 171 formed between the closing partition wall 181 and the head portion 161 of the moveable pump cover 16. When pneumatic pressure is introduced into the cavity 171 the head portion 161 is forced against the star wheel 14 while the rod portion 162 sealingly slides relatively to the closing partition wall 181, in a left direction in view of FIG. 1. At the same time the opening partition wall 182 fixedly arranged to the rod portion 162 will move to the left.

The pump casing further comprises at least one second hole 192 provided straight through the pump casing 11, for receiving a pneumatic opening pressure from an air pressure regulator (not shown). The second hole 192 accesses a cavity 172 formed between the closing partition wall 181 and the opening partition wall 182. When pneumatic pressure is introduced into the cavity 172 the head portion 161 is forced away from the star wheel 14 as the opening partition wall 182 is forced away from the closing partition wall 181, thereby allowing free flow through the pump during a clean in place (CIP) open state. Hence, in this scenario the rod portion 162 sealingly slides relatively to the closing partition wall 181, in a right direction in view of FIG. 1. At the same time the opening partition wall 182 fixedly arranged to the rod portion 162 will move to the right.

The impeller's 13 position is fixed in the self adjusting pump. The closing distance between the star wheel 14 and the impeller is adjusted via controlling the position of the pump cover 16. The position of the pump cover is controlled by the air holes 191 and 192. Adding air through 191 will add pressure to closing side of 182 and 161, thus maintaining a closed CIP state. In this situation there is no air added to 192. To change to the open clean in place state, air is added to 192, and released from 191. This will move the pump cover reverse to open position. When the pump is in the closed CIP state, e.g. the production state, but when air is added to 192, and released from 191, there will be a counter pressure from the product in the pump, that will try to force the pump open. By knowing this pressure of the product it's possible to add just enough air pressure through 191, that will ensure, that the clearance between the star wheel, pump cover and impeller is minimized, thus minimizing the wear on the parts, and giving highest possible performance.

Preferably, the pneumatic pressure introduced through the at least first hole 191 is conversely related to the pneumatic pressure introduced through the at least second hole 192. Hence, when pressure is introduced through the at least first hole 191, pressure will be released from the pump casing through the at least one hole 192.

The pneumatic pressure introduced through the at least first and second holes 191, 192 may be provided by means of an air pressure regulator 100. The air pressure regulator is controlled by a control unit 20 with processing capabilities which adaptively controls the operation mode of the air pressure regulator, and in particular the closing and opening pressure submitted to the pump.

Figure 2:
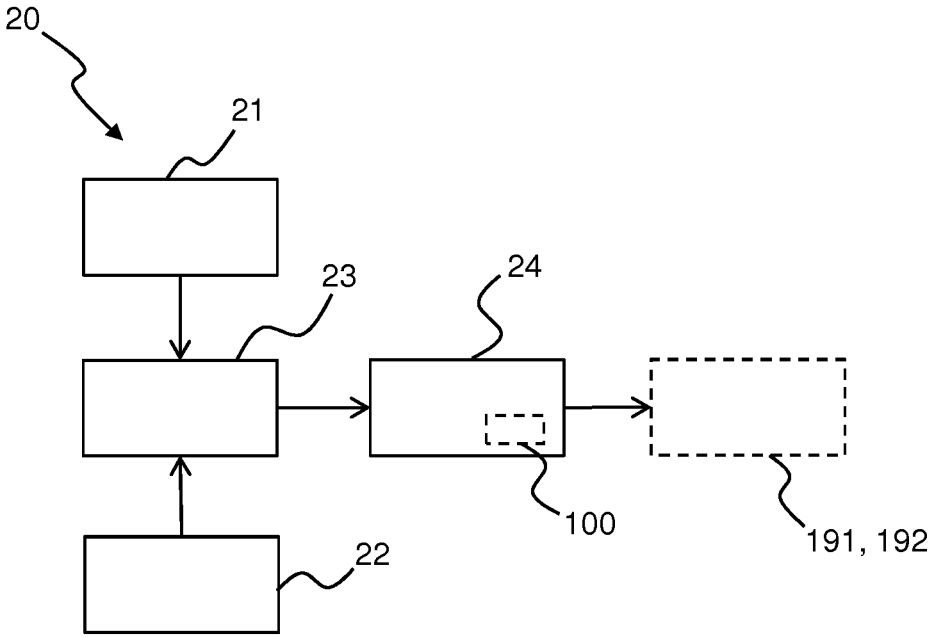
FIG. 2 shows a block chart of the functionality of a control unit according to an embodiment.

FIG. 2 illustrates a block chart of the operation of a control unit 20 according to an embodiment. The control unit 20 is arranged to receive 21 a first measure of food product supply pressure $P_{IN}$ indicating the fluid supply pressure entering the pump via the inlet 12 thereof. The control unit is further arranged to receive 22 a second measure of food product outlet pressure P2 indicating the fluid outlet pressure exiting the pump via the outlet 15. Moreover, the control unit is arranged to calculate 23 a closing air pressure being determined by the differential pressure between the food product outlet pressure $P_{OUT}$ and the liquid food product supply pressure $P_{IN}$ across the pump 10. The control unit is further configured to supply 24 the calculated closing air pressure $P_{CLOSE}$ to the pump cover 161 by means of the air pressure regulator 100 via the at least one hole 191 in the pump casing 11, thereby forcing the pump cover 161 against the star wheel 14 thereby closing the pump 10. The control may also be configured to supply a calculated opening pressure $P_{OPEN}$ via the at least one hole 192 in the pump casing, thereby releasing the pump cover from the star wheel thereby opening the pump 10.

Since in general two pumps are arranged in an ice cream freezer, and at different physical positions in the same, the food product supply pressure and food product outlet pressure may differ for each pump.

For the purpose of the present description, the food product supply pressure for a pump being positioned before the freezing cylinder of an ice cream freezer according to an embodiment is denoted by reference P1. The food product outlet pressure for the same pump is denoted P2. Moreover, the food product supply pressure for a pump being positioned after the freezing cylinder of an ice cream freezer according to an embodiment is denoted by reference P2. The food product outlet pressure for the same pump is denoted P3.

Figure 3:
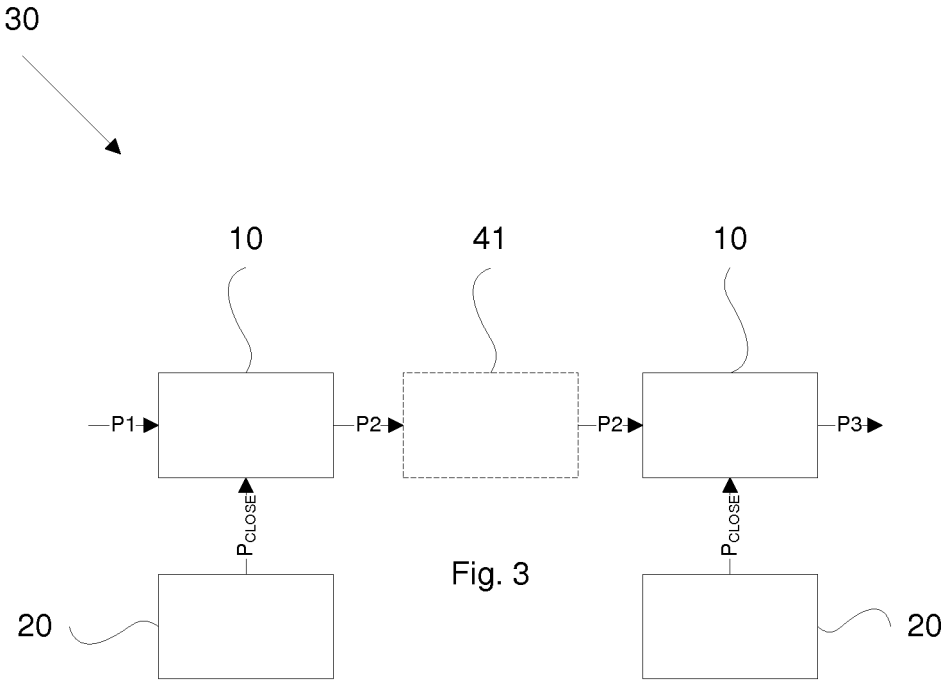
FIG. 3 shows a pump system according to an embodiment.

FIG. 3 illustrates a pump system 30 for an ice cream freezer according to an embodiment. The pump system comprises at least two pumps according to FIG. 1 positioned at either side of a freezing cylinder 41. The food product supply pressures P1, P2 and food product outlet pressures P2, P3 are indicated in FIG. 3. Each pump is operatively connected to control unit 20 for controlling the closing air pressure $P_{CLOSE}$ of the pump based on the differential pressure across the pump.

In FIG. 3 two control units 20 are shown. However, it should be appreciated that the functionality of controlling both pumps may be arranged in a single unit.

In an embodiment, the closing air pressure $P_{CLOSE}$ is based on the following formula:

$$\text{Closing air pressure[bar]}=\text{Differential pressure}*0.5+0.5$$

since by adding pressure to both opening partition wall 182 and head portion 161 the closing force, created by the air pressure, is doubled.

Figure 4:
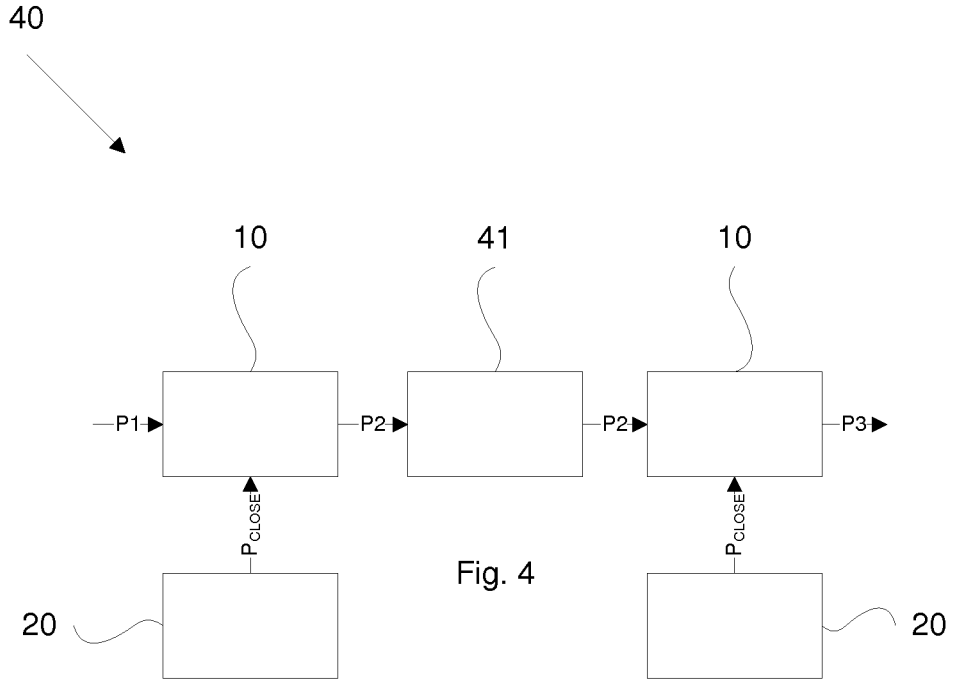
FIG. 4 shows an ice cream freezer according to an embodiment.

In an embodiment, according to FIG. 4, an ice cream freezer 40 is provided. FIG. 4 is similar to FIG. 3, however in FIG. 4 the freezing cylinder 41 is included in the ice cream freezer 40 whereas in FIG. 3 the pump system 30 does not include the freezing cylinder 41.

Figure 5:
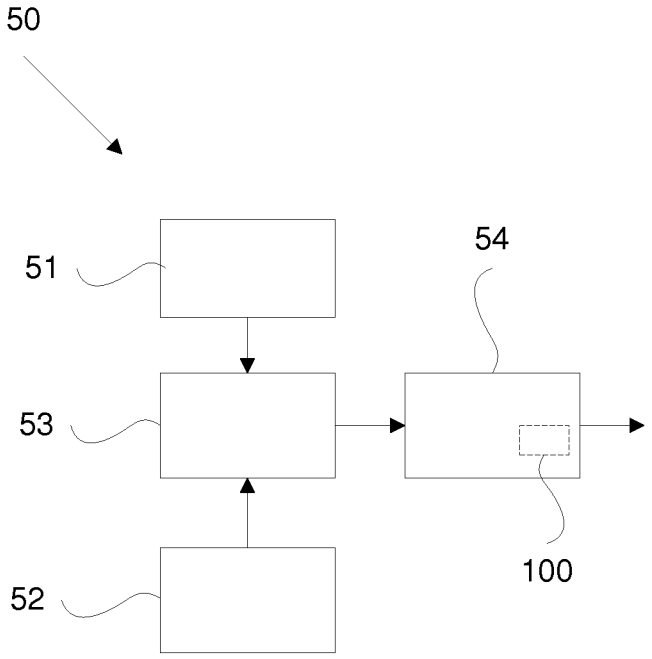
FIG. 5 shows a method of controlling a pump in an ice cream freezer according to an embodiment.

In an embodiment, according to FIG. 5, a method of controlling the operation of the pump 10 is provided. The method comprises 51 receiving 51 a first measure of food product supply pressure $P_{IN}$ indicating the fluid supply pressure entering the pump via the inlet 12 thereof. The method further comprises the step of receiving 52 a second measure of food product outlet pressure P2 indicating the fluid outlet pressure exiting the pump via the outlet 15. Moreover, the method comprises the step of calculating 53 a closing air pressure being determined by the differential pressure between the food product outlet pressure $P_{OUT}$ and the liquid food product supply pressure $P_{IN}$ across the pump 10. The method further comprises the step of supplying 54 the calculated closing air pressure $P_{CLOSE}$ to the pump cover 161 by means of the air pressure regulator 100 via the at least one hole 191 in the pump casing 11, thereby forcing the pump cover 161 against the star wheel 14 thereby closing the pump 10. The step of supplying 54 may further comprise supplying 54 a calculated opening air pressure $P_{OPEN}$ of fluid via the at least one hole 192 in the pump casing 11, thereby releasing the pump cover from the star wheel thereby opening the pump 10.

Although the above description has been made mostly with reference to pumps for an ice cream freezer, it should be appreciated that the disclosed self adjusting mechanism could be incorporated into pumps for other applications than freezing ice cream, such as various food related products, from dairy and meat industry, but also coffee extract.

Further, the invention has mainly been described with reference to a few embodiments. However, as is readily understood by a person skilled in the art, other embodiments than the ones disclosed above are equally possible within the scope of the invention, as defined by the appended claims.

The invention claimed is:

1. A pumping apparatus comprising:

a control unit for adaptively controlling closing pressure of an inlet gear pump, the inlet gear pump comprising a pump casing, an inlet for receiving a liquid food product of ice cream mix, and outlet for transferring the ice cream mix into a freezing cylinder, the inlet being connected to an impeller driving a star wheel which in turn is connected to the outlet, wherein the inlet gear pump is closed by supplying a closing air pressure onto a movable pump cover of the inlet gear pump via at least one hole provided straight through the pump casing, thereby moving said movable pump cover against the star wheel, wherein the control unit is configured to:

receive a first measure of liquid food product supply pressure at the inlet of the inlet gear pump, receive a second measure of liquid food product outlet pressure at the outlet of the inlet gear pump, calculate a closing air pressure being determined by a differential pressure between the liquid food product outlet pressure and the liquid food product supply pressure across the inlet gear pump, supply the calculated closing air pressure to the moveable pump cover by means of an air pressure regulator via the at least one hole in the pump casing, thereby forcing the moveable pump cover against the star wheel thereby closing the inlet gear pump.

2. The pumping apparatus according to claim 1, wherein the control unit is configured to calculate the closing air pressure using the formula:

$$\text{Closing air pressure[bar]}=(\text{Differential pressure}*0.5)+0.5.$$

3. The pumping apparatus of claim 1, comprising:

a gear pump system that comprises the inlet gear pump, and the control unit.

4. A pumping apparatus comprising:

a control unit for adaptively controlling closing pressure of an outlet gear pump, the outlet gear pump comprising a pump casing, an inlet for receiving a liquid food product of frozen ice cream from a freezing cylinder, and outlet for transferring the frozen ice cream for filling or extrusion, the inlet being connected to an impeller driving a star wheel which in turn is connected to the outlet, wherein the outlet gear pump is closed by supplying a closing air pressure onto a moveable pump cover of the outlet pear pump via at least one hole provided straight through the pump casing, thereby moving said moveable pump cover against the star wheel, wherein the control unit is configured to:

receive a first measure of liquid food product supply pressure at the inlet of the outlet gear pump, receive a second measure of liquid food product outlet pressure at the outlet of the outlet gear pump, calculate a closing air pressure being determined by a differential pressure between the liquid food product outlet pressure and the liquid food product supply pressure across the outlet gear pump, supply the calculated closing air pressure to the moveable pump cover by means of an air pressure regulator via the at least one hole in the pump casing, thereby forcing the moveable pump cover against the star wheel thereby closing the outlet gear pump.

5. The pumping apparatus of claim 4, comprising:

a gear pump system that comprises the outlet gear pump, and the control unit.

6. The pumping apparatus according to claim 4, wherein the control unit is configured to calculate the closing air pressure using the formula:

Closing air pressure[bar]=(Differential pressure*0.5)+0.5.

7. A method for adaptively closing a gear pump of an ice cream freezer, comprising:

receiving a first measure of liquid food product supply pressure at an inlet of the gear pump;

receiving a second measure of liquid food product outlet pressure at an outlet of the gear pump;

calculating a closing air pressure being determined by a differential pressure between the liquid food product outlet pressure and the liquid food product supply pressure across the gear pump; and supplying the calculated closing air pressure to a moveable pump cover of the gear pump by means of an air pressure regulator via at least one hole in a pump casing of the gear pump, thereby forcing the moveable pump cover against a star wheel of the gear pump, thereby closing the gear pump.

8. The method according to claim 7, wherein calculating the closing air pressure is performed using the formula:

Closing air pressure[bar]=(Differential pressure*0.5)+0.5.

* * * * *